United States Patent [19]

Sung et al.

[11] 4,171,269

[45] Oct. 16, 1979

[54] SULFURIZED LUBRICANT COMPOSITION

[75] Inventors: Rodney L. Sung, Fishkill; Benjamin H. Zoleski, Beacon, both of N.Y.

[73] Assignee: Texaco Inc., White Plains, N.Y.

[21] Appl. No.: 754,659

[22] Filed: Dec. 27, 1976

[51] Int. Cl.[2] ..... C10M 1/40; C10M 3/34; C10M 5/22; C10M 7/38

[52] U.S. Cl. ..... 252/33; 252/42.7; 252/45; 252/395

[58] Field of Search ..... 252/33, 42.7, 45, 395

[56] References Cited

U.S. PATENT DOCUMENTS

| | | | |
|---|---|---|---|
| 3,367,867 | 2/1968 | Abbott et al. | 252/42.7 |
| 3,377,281 | 4/1968 | Gower | 252/33 |
| 3,474,035 | 10/1969 | Dadura | 252/42.7 |
| 3,528,917 | 9/1970 | Dadura et al. | 252/42.7 |
| 3,562,159 | 2/1971 | Mastin | 252/33 |
| 3,761,414 | 9/1973 | Haugen et al. | 252/42.7 |
| 3,775,321 | 11/1973 | Turnquest et al. | 252/42.7 |
| 3,969,235 | 7/1976 | Sung et al. | 252/42.7 |
| 4,010,106 | 3/1977 | Rothert | 252/42.7 |
| 4,016,093 | 4/1977 | Koft | 252/42.7 |

*Primary Examiner*—Delbert E. Gantz
*Assistant Examiner*—Irving Vaughn
*Attorney, Agent, or Firm*—Thomas H. Whaley; Carl G. Ries; James J. O'Loughlin

[57] ABSTRACT

Lubricant oil comprising a hydrocarbon oil of lubricating viscosity; sulfurized normal or highly overbased calcium alkylphenolate a sulfurized overbased calcium alkaline earth metal hydrocarbyl sulfonate; a sulfurized naphthenic base oil-containing composition having a sulfur content of from 1 to 6 percent by weight; and a chloroparaffin containing about 40 percent to 60 percent by weight thereof of chlorine.

1 Claim, No Drawings

SULFURIZED LUBRICANT COMPOSITION

BACKGROUND OF THE INVENTION

This invention occurs in the field of art involving, generally, lubricating oils adapted for use between a plurality of relatively moving surfaces with which the fluid compositions are in contact for the purpose of reducing the friction between these surfaces while providing protection, concomitantly, from wear and corrosion. These fluid compositions, or lubricating oils, tend to deteriorate under conditions of use in present day diesel engines with attendant formation of sludge, lacquer and resinous materials which adhere to the engine parts; particularly the piston ring, groove and skirt, thus reducing the operating efficiency of the engine. To counteract the formation of these deposits, certain chemical additives have been found which when introduced into lubricating oils have the ability to keep the deposit-forming materials suspended in oil so that the engine is kept clean and in efficient operating condition for extended periods of time. These agents are known in the art to which this invention pertains as detergents, inhibitors, or detergent-inhibitors. Metal organic compounds are useful in this respect. One class of metal organic compounds which has been found particularly useful are the sulfurized normal and overbased calcium alkylphenolates. These agents are believed to be effective because they provide alkalinity capable of neutralizing strong organic and inorganic acids and are capable of inhibiting the formation of deposits and deposit precursors in the oil phase. Overbased and normal sulfurized metal alkylphenolates have been found to be particularly effective detergent-inhibitors in lubricating oils.

By the term "overbased" in this context is meant, generally, that the ratio of the number of equivalents of calcium to the number of equivalents of alkylphenolate moiety is greater than 1. In the present instance, the term is also used with particular reference to calcium alkylphenolates having a ratio of calcium metal to alkylphenolate moiety of at least 2.9:2. Ther term "overbased" also has reference herein to alkali metal hydrycarbyl sulfonates having, desirably, a TBN of at least 50. Many overbased sulfurized metal alkylphenolates having a calcium metal to alkylphenolate ratio greater than 1 and less than 1.7 have proven to be useful lubricant additives heretofore. Normal calcium alkylphenolates also provide useful lubricant additives. The term "normal" indicates that the ratio of the number of equivalents of calcium to alkylphenol moiety is 1. U.S. Pat. Nos. 3,528,917; 3,549,534; 3,761,414; and 3,969,325 describe lubricating compositions containing sulfurized normal calcium alkylphenolate detergent-inhibitors of improved resistance to oxidation. Illustrative of lubricant oil compositions containing sulfurized overbased calcium alkylphenolate detergent-inhibitors are those described in U.S. Pat. Nos. 3,474,035 and 3,706,632.

It has been found recently, however, that railway diesel engine oils having a high degree of alkalinity, that is, a TBN of at least 10, are particularly desirable in that they prevent corrosion by oil-soluble acids formed by oxidative deterioration at the high temperature existing under normal conditions of engine employment in proximity to the combustion chamber. The term "TBM" or "nominal TBM", as employed herein, refers to "total base number" which is defined as the quantity of acid, expressed in terms of the equivalent number of milligrams of potassium hydroxide that is required to neutralize all basic constituents present in one gram of a given sample. The method of evaluating alkalinity is that defined in ASTM Method D 664. While the foregoing alkalinity can be attained by introduction into the lube oil of a nominal 300 TBN forty percent of fifty percent overbased calcium sulfonate in a naphthenic oil carrier, the resulting lubricant compositions are unsatisfactory because these overbased materials degrade the silver protection characteristics of the oil, a factor of particular significance with respect to railway diesel engines, the vast majority of which, in the United States, and to a significant extent outside of the United States, as well, utilize silver-plated piston pin insert bearings.

Particularly useful lubricant compositions are those containing both substantially normal and highly overbased sulfurized calcium alkylphenolate and highly overbased alkaline earth metal sulfonate additives. One facet of this utility is the provision of finished lubricant oils for use in railway diesel engines having a TBN of at least 10 and thus capable of preventing corrosion by oil-soluble acids formed by oxidative deterioration at the high temperatures existing under normal conditions of engine use in proximity to the combustion chamber. Where a sulfurized naphthenic oil-containing composition (having a sulfur content by weight of at least 1 percent) is incorporated with the foregoing overbased additives, the destruction of the silver protective properties of the lubricant oil by the overbased calcium alkylphenolate is overcome, but not the similarly destructive properties of the alkaline earth metal sulfonate. Nevertheless, the incorporation of an alkaline earth metal sulfonate in these lubricant oils is most desirably because of the improved engine performance it provides over an extended period of time.

Thus, the production of a finished lubricant oil for use, particularly, in railway diesel engines having the necessary degree of alkalinity and, for this purpose, incorporating a normal or highly overbased sulfurized calcium alkylphenoate and an alklaine earth metal sulfonate, without diminution of the silver protective properties of the finished lubricant oil would provide a significant advance in the state of the art.

SUMMARY OF THE INVENTION

We have discovered, and this constitutes, generally, our invention, that an improved lubricant oil composition having a TBN of at least 10, and substantially less susceptible to oxidative deterioration even at the elevated temperatures existing in proximity to the combustion chamber of a present railway diesel ingine, when in use; and one providing improved engine performance; and protective of the silver components of the engine is secured using a sulfurized normal or highly overbased calcium alkylphenolate detergent-inhibitor; a highly overbased alkaline earth metal hydrocarbyl sulfonate; a sulfurized naphthenic lubricating oil incorporating from about 1 percent to about 6 percent by weight of elemental sulfur; and a chloroparaffin wherein there is contained in combined form, form 40 percent to 60 percent by weight of chlorine.

DETAILED DESCRIPTION OF THE INVENTION

More specifically, this invention is directed to lubricant oils capable of meeting standards of performance necessary to satisfy present day needs of railway diesel engines having silver-plated components. These rigorus standards include a significantly high degree of alkalinity, i.e., a nominal total base number ("TBN") of at least 10, and the ability simultaneously to provide protection to the silver-plated areas of the engine. Accordingly, the lubricant compositions of the invention comprise a hydrocarbon oil of lubricating viscosity; a sulfurized naphthenic lubricating oil additive incorporating about 1 percent to about 6 percent, and preferably within the range of about 2 percent to 5 percent, and most desirably about 3 percent, of sulfur (in elemental or combined form) by weight of the sulfurized oil additive; a chloroparaffin having a molecular weight of from 500 to 1000 wherein there is contained in combined form 40 percent to 60 percent by weight of chlorine; a sulfurized overbased calcium alkylphenolate detergent-inhibitor having a mole ratio of calcium metal to alkylphenolate ratio of at least 2.9 to 2 and not in excess of 3.5 to 2; and preferably 3:2, and a highly overbased alkaline earth metal (including barium, magnesium, and preferably calcium) hydrocarbyl sulfonate having a TBN of at least 50, and wherein the hydrocarbyl sulfonate is a petroleum sulfonate derivative.

The foregoing sulfurized overbased calcium alkylphenolate detergent-inhibitors are prepared, generally, by a step-wise process that comprises contacting, in the presence of a lubricant oil, an alkylphenol of the formula:

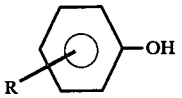

(I)

wherein R represents 1 or 2 monovalent saturated aliphatic hydrocarbon or alkyl radicals, each of from 4 to 50 carbons, and preferably 10 to 15 carbon atoms, and where, in said alkylphenol, at least one ortho or para position remains unsubstituted, with calcium alkoxyalkoxide of the formula:

$$Ca\text{-}(\text{-}O\text{-}A\text{-}OR')_2 \qquad (II)$$

wherein A is a divalent saturated aliphatic hydrocarbon radical (alkanediyl) of 1 to 6 carbon atoms and R' is an alkyl radical of from 1 to 25, and preferably 1 to 4 carbon atoms inclusive; said contact being effected at a temperature of from 50° F. to 425° F., and more desirably 200° F. to 425° F., in one step or two steps; and utilizing a mole ratio of calcium alkoxyalkoxide to said alkylphenol in said one step or in the total of said two steps of from 0.5:1 to 0.6:1; introducing sulfur at a temperature of from 165° F. to 460° F., and preferably 410° F. to 450° F., after the first of said foregoing steps, into contact with the resulting reaction mixture; utilizing a mole ratio of sulfur to initial alkylphenol of between 0.5:1 and 0.8:1, and in the presence of a hydrocarbon lubricating oil, said hydrocarbon oil constituting between about 13 percent and 20 percent by weight of said reaction mixture; to effect incorporation in said alkylphenolate of from 2 percent to 6 percent by weight of sulfur; and, where an overbased product, that is, one having a calcium metal to alkylphenolate ratio of at least 2.9:2, more desirably 2.9:2 to 3.5:2, and preferably 3:2, is being prepared for use in accordance with the invention, a further reaction mixture is formed by introducing into said immediately preceding reaction mixture, comprising a substantially normal (i.e. up to 10 percent overbased) sulfurized calcium alkylphenolate, a further addition of a calcium alkoxyalkoxide of said formula II at a temperature within said first temperature range in a mole ratio of 0.5:1 to 1:1 of said calcium alkoxyalkoxide to initial alkylphenol; and thereafter sequentially hydrolyzing said resulting reaction mixture and contacting the resulting hydrolyzed product with carbon dioxide.

Significantly preferred embodiments of the present invention involve more particularly, a sequence of steps the first of which is directed to contacting of the reactants of formulae (I) and (II) hereinabove in a lubricating oil in which they are reacted at a temperature of between about 320° F. and 425° F. in a mole ratio of calcium alkoxyalkoxide to alkylphenolate of between 0.225:1 and 0.45 to 1. The reaction is conducted until essentially all of the alkoxyalkoxide is reacted; a period generally of from about 0.5 to about 8 hours, to form the first calcium alkylphenolate reaction product.

As a second stage or step, the resulting first reaction product is contacted, after removal of volatile solvent (where present), with sulfur at a temperature between 440° F. and 460° F., and preferably about 450° F., in the presence of between about 13 and 20 weight percent (wt.%) of a hydrocarbon lubricating oil of an SUS viscosity of between 50° and 2,500° at 100° F. utilizing a mole ratio of sulfur to initial alkylphenol, respectively, of between 0.5 to 1 and 8 to 1; and preferably between about 0.5:1 to 3:1, to form a second reaction mixture. During this addition of sulfur there is passed through this second reaction mixture, sequentially, inert gas, carbon dioxide, and inert gas, the latter preferably nitrogen, until no detectible hydrogen sulfide ($H_2S$) odor is found, which is noramlly measured at less than 3 parts per million (ppm) $H_2S$, and a copper strip corrosion employing ASTM D-130 of a 2 A maximum (3 hours-212° F.). An inert carbon dioxide gas rate of between about 0.1 to 10 standard cubic feet per hour per gallon (SCFH/gallon) is advantageously employed. The carbon dioxide functions as a deodorizing agent whereas the inert gas functions to facilitate removal of volatile components in the reaction mixture. The reaction time in this second step or stage is generally between 0.5 hours and 10 hours. The resulting second reaction product is a sulfurized calcium alkylphenolate mixture having a sulfur content between 0.1 and 10 weight percent.

The gas blown second reaction product mixture, upon completion of the sulfurization step, is then contacted in a third step with a second quantity of a calcium alkoxyalkoxide of general formula (II) above, at a temperature between about 350° F. and 425° F., and preferably about 370° F., utilizing from 0.15 moles to 0.375 moles, of calcium alkoxyalkoxide per mole of original alkylphenol reactant, the first and second additions of calcium alkoxyaloxide totalling about 0.6 moles and between 100 percent and 120 percent of stoichiometric. The reaction time of this third stage is generally between about 0.5 and 8 hours. An inert gas flow, preferably of nitrogen, is introduced directly into the reaction mixture in this, as in the other addition stages recited herein (unless otherwise expressly indicated), preferably through the bottom of the reactor from where it is passed through the liquid in upward flow with continuous removal of the gas from the upper region of the reactor system. The nitrogen (or other inert gas), introduced at a rate of from 0.1 to 10 SCFH/gallon, exerts a positive pressure in the reactor system of between 1 and 4 p.s.i.g. This method, a standard one, is that employed preferably and normally in the other stages where gas transmission through a reaction mixture is described herein. Further, agitation is employed normally in all stages of the procedure in order to facilitate ingredient contact.

The third reaction product secured is a crude mixture of the sulfurized normal calcium alkylphenolate, wherein the number of equivalents of alkylphenolate to number of equivalents calcium is 1.

The mixture is stripped by continuing the inert gas flow, which is preferably nitrogen, as before, at a rate between about 0.25 and 0.6 SCFH/gallon at a temperature between about 150° C. and 200° C., permitting the low boiling volatile materials to be removed, such as 2-methoxyethanol, the usual solvent employed with the calcium alkoxyalkoxide reactant and entered into the raction mixture therewith. Stripping, as described with respect to the various stages of the present process, does not, however, affect removal of the diluent oils introduced in the individual steps of the process.

This third reaction product, a crude mixture of substantially normal sulfurized calcium alkylphenolate provides, after stripping and filtration, a preferred phenolate component for use in the compositions of the invention. Where however a very highly overbased lubricating oil is particularly efficacious, a preferred alternative phenolate is secured by an extension of the foregoing sequence in which the foregoing stripped product is introduced into a fourth step in which a fourth reaction mixture is formed incorporating the sulfurized normal calcium alkylphenolate of the third reaction product mixture and a further amount of calicum alkoxyalkoxide in a ratio within the range of 0.5 to 1 mole, and preferably, 0.5 mole, of calcium alkoxyalkoxide per 0.25 mole sulfurized calcium alkylphenolate; that is, from 100 wt.% to 200 wt.% of stoichiometric, to provide a crude mixture of the desired overbased sulfurized calcium alkylphenolate having a calcium metal value of at least 2.9, and preferably, 3. In this latter stage, additional hydrocarbon lubricating oil diluent is advantageously added bringing the total hydrocarbon oil diluent content in the third stage to about 40 to 70, preferably about 45 to about 55, and most desirably about 50, weight percent of the fourth stage raction mixture.

This latter, or fourth reaction or step, is undertaken at 370° C. and under conditions otherwise similar to those utilized in the third and immediately preceding reaction. The fourth reaction product is again stripped by continued nitrogen flow at a gas rate between about 0.25 SCFH/gallon and about 0.6 SCFH/gallon at a temperature between about 302° F. and 392° F. to remove the volatile materials present.

The stripped fourth reaction mixture is then contacted with water in a fifth reaction step or stage for a period of time, e.g., between about 0.1 and 10 hours, and preferably between about 2 and 4 hours, at a temperature between about 50° F. and 482° F. (preferably between 300° F. and 400° F.) utilizing a mole ratio of water to calcium alkoxide reactant of between about 100:1 and 0.2:1 while simultaneously blowing the reaction mixture with nitrogen gas at a rate of between about 0.1 and 0.2 SCFH/gallon, preferably about 0.15 and 0.2 SCFH/gallon. The water in the contacting may be either in its liquid or vapor form or mixtures thereof, and the contacting with water is continued until the overbased sulfurized calcium alkylphenolate is between about 20% and 70% hydrolyzed.

The water of the foregoing hydrolysis step is introduced preferably into the liquid reaction mixture at the bottom of the reactor as steam and passed therethrough. At the completion of the hydrolysis step the residual unreacted water is, desirably, substantially removed from the final reaction mixture, e.g., by stripping with nitrogen gas at a temperature between about 300° F. and 400° F. and at a rate of between about 0.25 and 0.60 SCFH/gallon. The term "substantially removed" is, in relation to the water present, intended to denote removal of water to the extent that less than 1 wt.% thereof by weight of the total fourth reaction product mixture remains.

It is to be noted that the extent of hydrolysis is dependent on time, temperature and reactant ratios, therefore, periodic sampling and analysis is necessary to determine the extent of hydrolysis. As a practical matter, once the amount of hydrolysis is decided upon the particular set of conditions necessary to produce the desired degree of hydrolysis can be determined for a given reactor, obviating the need for periodic sampling.

In the foregoing procedure, it is theorized that the calcium alkoxyalkoxide complexes with, or is dispersed by, the sulfurized normal calcium alkylphenolate and the water hydrolyzes a portion of the complex calcium alkoxyalkoxide moiety with about 50% hydrolysis of said moiety being optimum in respect to stability of the product at high metal ratios.

The hydrolyzed product mixture is treated with carbon dioxide passed through the reaction mixture at a gas rate of 0.1 to 10 SCFH/gallon for a period of about 2 to 4 hours to convert, it is believed, the excess of calcium present as calcium hydroxide to calcium carbonate which is retained in the product mixture and encompassed within the term "overbased" in describing the calcium alkylphenolate product employed in the finished lubricant compositions of the invention. The inert gas normally and preferably employed is nitrogen with a purity of at least 99 wt.%.

The rate of blowing with inert gas during overbasing, stripping of the overbased mixture and hydrolysis is signficant in determining viscosity. Rates employed outside the recited ranges result in a product of substantially increased viscosity. In regard to the unexpected importance of the use of nitrogen and the rate of introduction thereof, it is theorized that the nitrogen gas coupled with its rate of introduction has a direct effect on particle size of the formed hydrolyzed overbased sulfurized calcium alkylphenolate. One explanation is that a rate higher than the maximum produces particles so fine that they are inadequately coated and they agglomerate resulting in a too viscous product of reduced filterability and also a product which has poor solubility even upon filtration and oil dilution. It is further theorized that when the nitrogen gas rate is below the minimum set forth, particles are formed that are so large as to also result in an excessively viscous product and one having poor solubility even upon oil dilution. To summarize, nitrogen gas introduced during overbasing, stripping and hydrolysis affects particle size which in turn affects viscosity, filterability and solubility of the final product. To obtain minimum viscosity and maximum filterability and solubility, a particular set of conditions, ingredients and amounts coupled with a defined rate range of nitrogen gas blowing in the overbasing, stripping and hydrolysis phases is normally used.

The nitrogen gas employed has preferably an impurity content (oxygen and carbon dioxide) of less than about 0.5 wt. percent.

In a less preferred embodiment for formation of sulfurized overbased calcium alkylphenolates the initial contact of alkylphenol of formula (I) and calcium alkoxyalkoxide of formula (II) is effected at 50° F. to 425° F. and the sulfurization of the second step is thereafter undertaken at a temperature of between 400° F. and 410° F. The neutralization with calcium alkoxyalkoxide is also accomplished in a single step. The calcium alkoxyalkoxide employed is normally half-carbonated, additionally, using $CO_2$ gas. The resulting sulfurized normal calcium alkylphenolate is then overbased by the further sequence that comprises stripping of the sulfurized product, with completion thereafter of the fourth and fifth reaction steps in the same manner, including hydrolysis, stripping, and filtration, as described hereinabove with respect to the preferred overbased embodiment.

The desired sulfurized calcium alkylphenolate, whether normal or overbased and whether prepared by the preferred or less preferred methods described hereinabove, and even when purified in the manner described is, in actuality, a complex mixture of many compounds. One hypothetical formula employed in the art to represent this complex mixture is as follows:

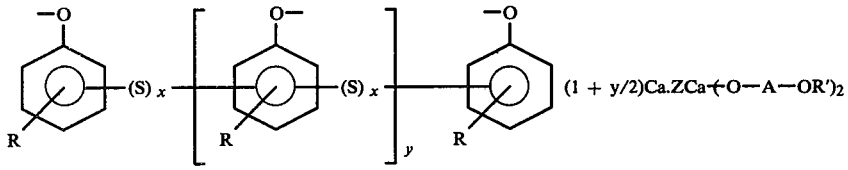

wherein R, R' and A are as heretofore defined, x is an integer from about 1 to 4, y is an average integer of from 0 to 10 and z is an average integer of 0 to about 0.1 when normal sulfurized calcium alkylphenolate prepared as described, illustratively, hereinabove and in Example I hereof, is employed in the practice of the invention; and is an average integer of about 1.9 to about 2.5, and preferably 2, when the overbased sulfurized calcium alkylphenolates, described herein, are used.

The foregoing formula is only set forth as a visual presentation since sulfurized calcium alkylphenolate is, in essence, a complex mixture of many substances including mono- and polysulfides, and therefore, the product can be truly defined only in terms of process. In any case, the R group is believed to be primarily in the para position and the sulfur linked mainly in the ortho position. Further, there is probably also a significant amount of covalent character for the calcium-oxygen bond. It is to be noted that the calcium and sulfur contents of the sulfurized calcium alkylphenolate components are respectively between about 6.0 wt.% and 7.3 wt.% and about 0.5 wt.% and 12 wt.%.

While the sulfur content of each of the normal and overbased calcium alkylphenolates of the preferred and less preferred embodiments for use herein are the same; as indeed, are the calcium contents of the preferred and less preferred overbased calcium alkylphenolates; the preferred normal and overbased embodiments provide, in combination with the other components coming within the ambit of this invention, a composition that is significantly superior in securing better engine performance.

Illustrative of the alkylphenol reactants contemplated for use herein are 4-octylphenol, 4-t-octylphenol, 2-decylphenol, 2-dodecylphenol, 4-hexadecylphenol, 3,4-didodecylphenol 2-nonylphenol, 4-triacontylphenol, 4-eicosylphenol and a mixture of decyl and dodecylphenol ($C_{10}$–$C_{12}$) alkylphenol and a mixture of the 2 and 4 positioned monoalkyl and dialkylphenols. It is to be noted that the alkylphenols employed will normally be p-alkylphenols. The 2,4-disubstituted alkylphenols may be present in minor amounts; generally, not in excess of 10 wt.% can be tolerated without detrimental effect.

Examples of the calcium alkoxyalkoxide reactants contemplated herein are calcium 2-methoxyethoxide, calcium 2-methoxypropoxide, calcium 3-methoxybutoxide, calcium 2-ethoxyethoxide and calcium 4-dodecoxyhexoxide. Their corresponding alkoxyethanol diluents are 2-methoxyethanol, 2-methoxypropanol, 2-methoxybutanol, 2-ethoxyethanol and 4-dodecoxyhexanol.

The normal and final overbased alkylphenolates of the third and fifth stage reactions, respectively, including $CO_2$ treatment, and, in the latter instance, hydrolysis, may be further purified by standard means, for example, by distillation of the diluent and by-products, such as the alkoxyalkanol which is not otherwise removed with the excess water. The product mixture is, in any event, filtered, if required, by standard means. The preferred filtration is accomplished by adding to the final mixture between about 0.10 wt.% and 1 wt.% of diatomaceous earth and passing the material to be filtered through a press leaf filter precoated with the foregoing filtration medium at a temperature between 200° F. and 300° F. and at a pressure of 5 to 1000 p.s.i.g.

The diluent oil remaining upon completion of the third or fourth reaction, whichever is elected as the last such treatment step, is made, as indicated hereinabove, to form lubricant concentrates suitable for transport and storage, of from about 45 wt.% to not in excess of 55 wt.%, and preferably 50 wt.%, including the sulfurized alkylphenolate; overbased alkaline earth metal sulfonate; lubricating oil and chloroparaffin additives. Suitable diluent or base oils include a variety of hydrocarbon lubricating oils such as naphthenic base, paraffinic base and mixed naphthenic and paraffinic base, oils having as SUS viscosity at 100° F. of between about 50 to 250 and preferably between about 90 and 150.

To comply with the critical requirements of the invention, it is necessary, as indicated, that the sulfurized calcium alkylphenolate product of the fifth reaction be blended in the finished lubricant composition with from about 2 wt.% to 6 wt.%, more desirably, 2 wt.% to 3 wt.%, and preferably about 2 wt.% of the sulfurized naphthenic lubricating oil additive, comprising a sulfurized naphthenic hydrocarbon, and preferably one having an SUS viscosity at 100° F. of 100, and containing, also most desirably, a sulfurized lard oil formed essentially of triglycerides of $C_{12}$ to $C_{20}$ fatty acids, and particularly and preferably triglycerides of myristic, palmitic and stearic, oleic and linoleic acids, in amounts which, whule not narrowly critical have been found particularly useful in concentrations of 1, 26, 11.5, 58 and 3.5 wt.%, respectively. The foregoing additive may contain inert impurities in amounts of up to 1 wt.% without adverse effect on the additive composition or its usefulness for the purpose of this invention; or may include, desirably, an anti-wear phosphate additive such as tricesyl phosphate in this concentration. The foregoing sulfurized naphthenic oil additive is sulfurized from about 1 wt.% to 6 wt.%; more desirably from about 2 wt.% to 3 wt.%; and most desirably to an extent of 2.0 wt.%; the sulfur being incorporated in combined form and sulfurization being accomplished by standard means. This sulfurized additive has an SUS viscosity at 100° F. normally within the range of 119 to 255 and preferably about 255, and an API gravity of 19.9.

The chlorinated paraffin for use herein is, in addition to having, as indicated hereinabove, an elemental chlorine content in combined form of from about 40 to 60 percent by weight, characterized by a molecular weight of from 500 to 1000, and preferably 500 to 600. The amount of additive present will correlate generally with the concentration of calcium sulfonate, within the permissible limits recited herein, incorporated in the lubricant oil composition of the invention, but will, in any event, be within the range of 0.05 wt.% and 5 wt.% of the total lubricant oil composition.

The overbased alkaline earth metal sulfonate detergent-inhibitors employed herein are, as indicated above, those wherein a hydrocarbyl moiety is present and the alkaline earth metal is barium, magnesium, or calcium, or indeed, mixtures thereof, but where calcium is the preferred metal. The hydrocarbyl sulfonate of these alkaline metal hydrocarbyl sulfonates is derived from petroleum sulfonates and includes, illustratively, alkyl, alkylaryl, arylalkyl and aryl sulfonates and mixtures thereof containing, in the case of alkyl substituents, from 1 to 24 carbon atoms or more; where aryl moieties are present, from 6 to 24 carbon atoms or more, and alkyl and arylalkyl radicals from 7 to 24 carbon atoms or more. The molecular weight of the product sulfonates is from about 300 to about 1000 normally and preferably about 900. Illustrative of these sulfonates are barium nonylbenzene sulfonate, magnesium dodecylbenzene sulfonate and calcium octadecylbenzene sulfonate. Where derived as preferred from a petroleum sulfonate mixture in combination with calcium these sulfonates are characterized as calcium alkylbenzene sulfonates having a molecular weight within the foregoing recited range.

These sulfonate detergent additives are calcium (or barium or magnesium) carbonate overbased derivatives are formed, illustratively, by blowing a mixture of calcium hydroxide and calcium alkylsulfonate or calcium alkyarylsulfonate with carbon dioxide to form a product having TBN of 50 or more; that is within the range of 50 to 600; more desirably about 280 to 400; and most desirably about 290. The alkaline earth metal carbonate, e.g. calcium carbonate, incorporated in the alkaline earth metal sulfonate present in the lubricant oil mixtures of the invention are embraced, il'ustratively, by the terms, "overbased alkaline earth metal sulfonates," "overbased alkaline earth metal hdyrocarbyl sulfonate," and "overbased calcium sulfonate" and variations thereof employed herein.

These detergent-dispersants are employed in an amount by weight of alkaline earth metal present in the total lubricant oil composition of between about 0.2 percent and about 0.5 percent, and preferably about 0.1 percent to 0.2 percent, the former in the "concentrates" described hereinafter and the latter proportions in the finished dilute lubricant oils of the invention for a total range of 0.1 wt.% to 0.4 wt.%.

The foregoing sulfonates are incorporated with the other additives and base oils recited herein in a naphthenic diluent in an amount by weight of 45 percent to 60 percent, and preferably about 50 percent. This naphthenic oil serves also as a base oil and is the same as those oils specified for use as diluents with the calcium alkylphenolate component defined herein and for use as a base oil in formulating the concentrates and finished lubricant oils of the invention.

The formed sulfurized calcium alkylphenolate product content in lubricating oil compositions contemplated herein range anywhere from 0.1 to 90 wt.%. The higher concentrations, e.g. between about 45 and 55 wt.%, referred to herein as "concentrates" are found normally as, and result directly from, the manufacture of the sulfurized calcium alkylphenolate ingredient. Those concentrates, containing about 0.4 to about 1.0 percent of sulfurized calcium alkylphenolate, expressed as wt.% of calcium by weight of the total lubricant composition employed for railway diesel engine use, are diluted with the lubricant base oil of the finished lubricant oil compositions in a concentration by weight of calcium of 0.2 wt.% to 0.4 wt.%; for an over-all range of 0.2 wt.% to 1.0 wt.%. The concentrates are, as thus indicated, principally formed for storage and transportation and are subsequently blended to finished oil compositions for engine use.

The concentration of alkaline earth metal, and, as indicated preferably, calcium, of the sulfonate component and the calcium metal concentration of the phenolate in a finished (dilute) lubricating oil prepared according to the practice described herein should, in any event, total at least, and in a significantly preferred embodiment, be, about 0.5 wt.%, and consequently about 0.9 to 1.1% in concentrate form. The concentration employed is sufficient, in any event to effect an alkalinity, manifested as a nominal TBN, of at least 10; preferably about 10 to 20, and for reasons of economy, most desirably about 10, in the finished (dilute) lubricant oils of the invention.

In forming the sulfurized calcium alkylphenolate employed in the foregoing blend of the present invention the calcium alkoxyalkoxide reactant is introduced in the first, third, and, if overbased in accordance with the preferred process, the fourth reaction mixtures, usually as a solution, as indicated hereinabove, to facilitate reaction contact. The solvent medium is, as has been noted, usually the corresponding alkoxy-substituted alkanol. The preferred alkoxyalkoxide is calcium methoxyethoxide, and consequently the alkanol is normally 2-methoxyethanol. The concentration of the calcium alkoxyalkoxide in the solvent medium is normally between about 20 wt.% and 60 wt.%. The solvent is conveniently and advantageously removed as overhead effluent during the early phases of each step. Preparation of the calcium alkoxyalkoxide reactant is disclosed, by way of illustration, in U.S. Pat. No. 3,706,632.

With respect to the criticalness of the proportions, i.e. 13 wt.% to 20 wt.% of hydrocarbon lubricating oil diluent, in the second, or sulfurized, stage, it is believed that where amounts in excess thereof are used, the oil produces too many sites in competition with the calcium alkylphenolate for the sulfur, with the result that reduced amounts of sulfur attach to the alkylphenol moieties, thus rendering a product more susceptible to oxidative deterioration. It is also theorized that where less than about 13 wt.% of diluent oil is employed in the sulfurization stage, product results having lower sulfur-alkylphenol bonding, since it appears that the reaction is significantly retarded in this instance.

While it is theorized that the efficacy of the overbased sulfurized calcium alkylphenolate employed herein is explained, in part, by the complex mixture of compounds encompassed therein including monosulfides and relatively unstable polysulfides; and the production predominantly of monosulfides at the reaction temperatures of 440° F. to 460° F. in the preferred normal and overbased embodiments recited herein; unstable cleavage products being produced above this range and the unstable polysulfides resulting in increased amounts below this range, no reasonably conclusive explanation is available to explain why the sulfurized calcium alkylphenolate of the invention in combination with an alkaline earth metal hydrocarbyl sulfonate, the foregoing sulfurized naphthenic oil additive and chloroparaffin of the invention, as characterized herein, provide the superior silver protective properties that they do.

In the finished lubricating oil composition, other additives may be included such as supplementary dispersants, pour depressors, antioxidants, viscosity index improvers, oleogenous agents, antifoamants and mixtures thereof.

Supplemental additives which are desirably included in the lubricant compositions of the invention having particular application to railway diesel engines are ethoxylated inorganic phosphorus acid free, steam hydrolyzed, polybutene-$P_2S_5$ reaction products further described in U.S. Pat. Nos. 3,272,744, 3,087,956; and 3,123,630 included herein by reference. These supplementary dispersants appear to cooperate with the subject overbased sulfurized calcium alkylphenolate and sulfurized base oil to enhance detergency and thermal stability and resistance to undesired oxidative decomposition. The ethoxylated product is present in the finished compositions of the invention in amounts between 0.3 and 10 wt.% (oil free basis), preferably between about 0.8 and 4 wt.%, and in any case in sufficient amount to give a phosphorus content in the finished (dilute) compositions of between about 0.01 and 0.08 wt.%.

The foregoing supplemental ethoxylated phosphorus containing detergent-dispersant is prepared by first reacting a polybutene of a molecular weight of between about 800 and 2500 wherein the reaction occurs with about 5 to 40 wt.% $P_2S_5$ at an elevated temperature of between about 212° F. and 600° F. in a non-oxidizing atmosphere, e.g., nitrogen, followed by hydrolysis of the resulting product by contact thereof with steam at a temperature between about 212° and 500° F. The steam treatment of the $P_2S_5$-polybutene reaction product results in its hydrolysis to form inorganic phosphorus acids in addition to the hydrolyzed organic product. Hereinbefore and hereinafter the term "polybutene" denotes derivatives of isobutene as well as butene. The inorganic phosphorus acids are removed from the hydrolyzed product prior to reaction with alkylene oxide by means of standard procedures such as those disclosed in U.S. Pat. No. 2,987,512 and U.S. Pat. No. 2,951,835 wherein removal is effected by contact with, for example, synthetic hydrous alkaline earth metal silicates. Inorganic phosphorus acids can also be removed by extraction with anhydrous methanol as disclosed in U.S. Pat. No. 3,135,729. The steam hydrolyzed organic phosphorus acid product is then contacted with ethylene oxide at a temperature between about 140° and 300° F. under pressure ranging from 0 to 50 psig utilizing a mole ratio of ethylene oxide to hydrolyzed hydrocarbon-$P_2S_5$ reaction product of between about 1:1 and 4:1, preferably between about 1.1:1 and 1.5:1. Excess ethylene oxide is removed after completion of the reaction by blowing the reaction mixture at an elevated temperature, generally with inert gas such as nitrogen. The foregoing reactions are conducted in the presence of a hydrocarbon lubricating oil of the kind used as a diluent in preparation of the sulfurized overbased calcium alkylphenolate of the invention. The lubricating oil normally constitutes between about 20 and 80 wt.% of the reaction mixture. The introduction of the hydrocarbon lubricating oil normally takes place subsequent to steam hydrolysis. The ethoxylated derivate, on an oil free basis, normally has a sulfur content of between about 2 and 5 wt.% and a phosphorus content of between about 4 and 6 wt.%.

Specific examples of the ethoxylated derivative of the foregoing free of inorganic phosphorus containing acids, steam hydrolyzed polybutene-$P_2S_5$ reaction products, are ethoxylated steam hydrolyzed, polyisobutene (1100 molecular weight, -$P_2S_5$ reaction product; ethoxylated, steam-hydrolyzed polybutene (1500 m.w.)-$P_2S_5$ reaction product; ethoxylated, steam-hydrolyzed polybutene (800 m.w.)-$P_2S_5$ reaction product, and ethoxylated, steam hydrolyzed, polyisobutene (2000 m.w.)-$P_2S_5$ reaction product. The ethylene oxide component and the reaction product component are present in each of the foregoing compositions in a mole ratio of 1:1.

Other supplementary detergent dispersants, employed as alternatives to the aforedescribed ethoxylated, steam hydrolyzed, polybutene $P_2S_5$ reaction products, are the $C_{50}$–$C_{200}$ alkenyl succinimide derivatives of alkylene polyamines of the type described in U.S. Pat. No. 3,172,892 and U.S. Pat. No. 3,210,383. These alternative supplementary succinimide detergents are characterized by the formula:

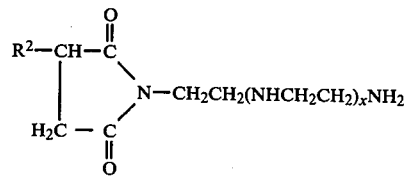

wherein $R^2$ is alkenyl of from 50 to 2000 carbons and x is an integer of from 0 to 10. Particularly suitable examples are where $R^2$ is polyisobutylene of a molecular weight of about 1000 to 1500 and x is 4 or 5 and mixtures thereof.

Like the foregoing polybutene-$P_2S_5$ derivative, this succinimide detergent appears to complement the sulfurized compositions of the invention to enhance their detergency, thermal stability and resistance to undesired oxidative decomposition. The succinic anhydride derivative is present in the finished composition of the invention on a neat basis of between 1.0 and 10 wt.% and in sufficient amount to give a nitrogen content in the finished (dilute) composition of between about 0.01 and 0.12 wt.%, preferably between about 0.015 and 0.3 wt.%.

Still another additive which may be included in the compositions of the invention in addition to the foregoing supplementary detergents are the 2,5-bis-$C_5$–$C_{20}$ alkyldithio thiodiazoles, such as 2,5-bis(octyldithio)-thiadiazole, which function as antioxidants, sulfur scavengers and antiwear agents. The dithiothiadiazoles are advantageously employed in an amount of between 0.01 and 1 wt.%, and preferably between 0.02 and 0.1 wt.% of the finished oil composition.

A still further specific additive which is advantageously included along with the supplementary detergent and antioxidant is the polymeric dimethyl silicone antifoamant. The silicone polymers are desirably employed in amounts of about 100 to 1000 ppm.

The present invention is further illustrated by the following examples, which are not, however, to be construed as limitations thereof. In these examples, as in the remainder of this specification, all references to "parts" or "percentages" are references to parts or percentages by weight unless otherwise expressly indicated.

EXAMPLE I

This example illustrates the preparation of a preferred product of the invention. Throughout the procedure, including each of the steps, described hereinafter, nitrogen blowing of the reaction mixture was conducted at 500 cubic centimeters per minute (cc/min.), unless blowing with $CO_2$ is specified.

Step 1. To a 12 liter flask fitted with a Dean-Stark trap and an inert gas inlet, there was charged 2800 grams of 4-dodecylphenol at ambient temperatures and the product was heated for a period of 2.5 hours at 330° F. There was then charged 1263 grams (2.8 mole calcium) of a 42.3 wt.% Ca. solution of calcium 2-methoxyethoxide in 2-methoxyethanol over a period of 1 hour and the methoxyethanol together with other volatile by-product materials were stripped off for a period of 4.5 hours during which time the temperature was raised from 330° to 410° F.

Step 2: To the calcium alkylphenolate reaction mixture of Step 1, there was charged over an hour period a sulfur slurry (420 grams sulfur+500 grams naphthenic oil of an SUS viscosity of about 110° at 100° F.) while maintaining the temperature at 410° F. Subsequently, the resultant mixture was heated over an hour period from 410° to 450° F. and maintained at 450° F. for an additional 6 hours, followed by $CO_2$ blowing (500 ccs/minute) for a 1 hour period at 450° F. and then nitrogen blowing gas reinstituted for an additional hour at that temperature.

Step 3: The sulfurized reaction mixture of Step 2 was cooled to 350° F. over an hour period and an additional 2630 grams of the aforedescribed naphthenic lube oil was added and the resultant diluted mixture was reheated over a ⅔ hour period from 280° to 330° F. At the end of the reheating period, an additional 1263 grams (2.8 mole calcium of a 42.3 wt.% solution of calcium 2-methoxyethoxide in methoxyethanol were added over an hour period at 330° F. Subsequently, the resultant reaction mixture is nitrogen stripped to remove methoxyethanol solvent and volatile by-products over a period of four hours while during that period the temperature is raised from 300° F. to 410° F.

The resulting product was filtered utilizing a vacuum filter at 300° F. for a period of 3 hours. Analysis of the filtrate determined the product to be a lube oil concentrate of sulfurized calcium dodecylphenolate, the concentrate giving an analysis as follows: wt.% Ca: 3.3; wt.% sulfur: 2.8; TBN: 92.

This sulfurized normal calcium phenolate reaction product is then introduced into a lubricating oil in a concentration of 0.3 wt.% together with 2 wt.% of a second sulfurized additive oil composed of 9 wt.% sulfurized lard oil, 90 wt.% of sulfurized hydrocarbon base oil (including 90 wt.% of pale stock) having an SUS viscosity at 100° F. of 100; and 1 wt.% tricresyl phosphate. This latter additive contains 3 wt.% of sulfur. This additive is further characterized by an SUS viscosity at 100° F. of 255 and an API gravity of 19.9. The sulfurized lard oil component contains essentially triglycerides of the following unsaturated fatty acids in the amounts by weight indicated: myristic acid, 1 percent; palmitic acid, 26 percent; stearic acid, 11.5 percent; oleic acid, 58 percent; and linoleic acid, 3.5 percent. The mineral oil of lubricating viscosity with which the foregoing overbased sulfurized alkylphenolate and sulfurized additive oil are blended is composed of 2.32 wt.%, 300 Pale Oil, 54.24 wt. SNO-40 and 43.44 wt.% 75/80 Pale Oil Also incorporated in this blend is 1 percent of a chloroparaffin having a molecular weight of about 500 and a chlorine content in combined form of 40 percent by weight; and a $CaCO_3$ highly overbased hydrocarbyl sulfonate wherein the hydrocarbyl sulfonate is derived from petroleum sulfonates incorporating a substantial proportion of calcium alkylbenezene sulfonate; the sulfonate having a molecular weight of about 500 and a TBN of about 290.

Further additives introduced simultaneously into the foregoing blend are 2.5-bis(octyldithio) thiodiazole in an amount by weight of 0.02 percent and the amine detergent-dispersant prepared by reaction of approximately equal mole amounts of tetraethylene pentamine and alkenylsuccinic anhydride in which the alkenyl radical is approximately 1200 molecular weight polybutene; the detergent-dispersant content being present in an amount sufficient to provide a nitrogen content by weight of the total composition of 0.02 wt.%. The weight percentage of components recited forming the finished lubricant blend are by weight of the total finished product in each instance. Also included in this blend are 50 parts per million of standard silicone antifoamant (Dow-Corning "300") to furnish a finished lubricant oil coming within the practice of the invention.

The lubricant oil of the invention, so prepared, manifests excellent results, as evidenced by acceptably low viscosity level, when subjected to the Union Pacific Oxidation Test (UPOT).

The UPOT consists of heating each of the oils to be tested for 144 hours at 285° F. with oxygen bubbling at 5 liters per hour in the presence of a Cu-Pb steel bearing strip as the catalyst. An acceptable increase in viscosity of a test oil during the test period may not exceed 20 percent.

EXAMPLE II

This example illustrates a further embodiment of the present invention and demonstrates the superiority of the compositions of the invention in protection of silver-plated surfaces.

The finished lubricant blend, prepared as described in Example I, containing normal calcium dodecylphenolate, overbased calcium sulfonate, sulfurized naphthenic base oil additive and chloroparaffin, were tested with like compositions for which, however, for test pruposes, the sulfurized naphthenic oil additive and chloroparaffin were variousiy removed or present to demonstrate and determine the silver protective properties of the lubricant oil compositions of the invention. This comparative testing procedure and the results secured are recited in Table I and the discussion that follows:

| Composition* | Formulation A | B | C | D |
|---|---|---|---|---|
| Base oil** (wt.%) | 96.53 | 97.53 | 98.53 | 99.53 |
| Normal sulfurized Ca alkylphenolate (% Ca) | 0.3 | 0.3 | 0.3 | 0.3 |
| Alkenyl succinic anhydride (% N) | 0.02 | 0.02 | 0.02 | 0.02 |
| 2,5-bis(octyldithio) thiadiazole (wt. %) | 0.05 | 0.05 | 0.05 | 0.05 |
| Sulfurized naphthenic oil (wt. %) | 2 | 2 | — | — |
| Chloroparaffin (wt. %) | 1 | — | 1 | — |
| Overbased Ca sulfonate (% Ca) | 0.1 | 0.1 | 0.1 | 0.1 |

*The components recited are those identified in Example I. There is also blended into each of the compositions of this Table I, 50 ppm of the silicone anti-foamant Dow-Corning "300".
**2.32% Pale Oil; 54.24% SNO-40; 43.44% 75/80 Pale Oil.

The composition of Formulation A in Table I is that of the invention described hereinabove in Example I. All of the formulations contain the requisite normal calcium-containing sulfurized alkylphenolate and sulfonate compositions. The sole variables from the composition of the invention (Formulation A) are the absence of one or both of the sulfurized naphthenic oil and chloroparaffin additives.

Samples of Formulations A, B, C and D of Table I are tested in what is known to those skilled in the art as the Texaco Modified Silver Disc Friction Test. This procedure is a laboratory test for determining the anti-wear properties of a lubricant oil. The test machine comprises a system wherein a one-half inch diameter 52100 steel ball is placed in assembly with three one-half inch silver discs of like size and of a quantity identical to that employed in the plating of the silver pin insert bearing or railway diesel engines manufactured by the Electromotive Division (EMD) of General Motors, Inc. These discs are disposed in contact with one another in one plane in a fixed triangular position in a reservoir containing the oil sample to be tested for its silver anti-wear properties. The steel ball is positioned above and in contact with the three silver discs. In carrying out these tests, the ball is rotated while it is pressed against the three discs at the pressure specified and by means of a suitable weight applied to a lever arm. The test results are determined by visual reference, using a low power microscope, to the scars on the discs, the scar texture, whether scored or smooth, for example, and coloration, in a rating system using a standard for comparison and a classification of "poor," "fair," "good" and "excellent." The rotation of the steel ball on the silver discs proceeds for a period of 30 minutes at 600 revolutions per minute under a 60 kilogram static load. Each oil is tested at 300° F. 400° F., 450° F., and 500° F.

Under these test conditions, the foregoing lubricant oil of the invention, Formulation A of Table I, was determined to be "excellent" in providing adequate silver anti-wear properties; whereas the lubricant oil of Formulation B, from which the chloroparaffin additive was omitted; and Formulation C, from which the sulfurized naphthenic oil was absent, and Formultion D, in which neither the sulfurized naphthenic oil or chloroparaffin were present were characterized as "poor."

It will be evident that the terms and expressions employed herein are used as terms of description and not of limitation. There is no intention, in the use of these descriptive terms and expressions, of excluding equivalents of the features shown and described, or portions thereof, and it is recognized that various modifications are possible within the scope of the invention claimed.

What is claimed is:

1. A lubricating oil composition comprising:

a hydrocarbon base oil of lubricating viscosity having an SUS viscosity at 100° F. of between about 50 and 250;

a sulfurized overbased calcium alkylphenolate having a calcium metal to alkylphenol ratio of at least 2.9:2; a calcium content by weight of the total composition of between 6 and 7.4 percent, and a sulfur content of between 0.5 percent and 12 percent of the total composition;

wherein said sulfurized calcium alkylphenolate is produced by the step-wise process that comprises:

(1) introducing into contact with an alkylphenol of the formula:

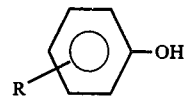

(I)

wherein R is from 1 to 2 monovalent alkyl radicals, each containing from 4 to 50 carbons, a calcium alkoxyalkoxide of the formula:

$$Ca\text{-}(\text{-}O\text{-}A\text{-}OR')_2 \quad \text{(II)}$$

wherein A is an alkanediyl radical of from 1 to 6 carbon atoms, and R' is an alkyl radical of from 1 to 25 carbon atoms, at a temperture between 200° F. and 425° F., utilizing a mole ratio of calcium alkoxyalkoxide to said alkylphenol of from 0.5:1 to 0.6:1;

(2) introducing into contact with the resulting reaction mixture, sulfur in the presence of carbon dioxide at a temperature of from 410° F. to 450° F., utilizing a mole ratio of sulfur to initial alkylphenol of between 0.5:1 and 8:1, and a hydrocarbon lubricating oil, said hydrocarbon oil constituting between about 13 percent and 20 percent by weight of said reaction mixture; to effect incorporation in said alkylphenolate of from 2 percent to 6 percent by weight of sulfur to form sulfurized calcium alkylphenolate, (3) forming a third reaction mixture by further introducing into said sulfurized calcium alkylphenolate a further addition of a calcium alkoxyalkoxide of said formula II in the presence of carbon dioxide at at temperature within said first temperature range in a mole ratio of 0.5:1 to 1:1 of said calcium alkoxyalkoxide to initial alkylphenol; and (4) thereafter hydrolyzing said third reaction mixture to form a sulfurized overbased calcium alkylphenolate, an overbased calcium hydrocarbyl sulfonate in which said hydrocarbyl moiety is derived from petroleum and said sulfonate has a molecular weight ranging from about 300 to 700 and having a TBN at least 50, said sulfurized overbased calcium alkylphenolate and said overbased calcium hydrocarbyl sulfonate being employed at a concentration in said lubricating oil composition to give said lubricating oil composition an alkalinity expressed as total base number of at least 10;

an effective silver anti-wear amount of a second sulfurized additive composition comprising a sulfurized naphthenic hydrocarbon lubricating oil wherein combined sulfur is present within a range of about 1 percent to about 6 percent by weight, and a chlorinated paraffin having a molecular weight ranging from 500 to 1000 and containing elemental chlorine in combined form amounting to from about 40 to 60 percent by weight of said chlorinated paraffin.

* * * * *